US008192042B2

(12) United States Patent
Tseng

(10) Patent No.: US 8,192,042 B2
(45) Date of Patent: Jun. 5, 2012

(54) LIGHT-EMITTING DECORATIVE ACCESSORY

(76) Inventor: Shen-Ko Tseng, Taipei (TW)

( * ) Notice: Subject to any disclaimer, the term of this patent is extended or adjusted under 35 U.S.C. 154(b) by 402 days.

(21) Appl. No.: 12/684,101

(22) Filed: Jan. 7, 2010

(65) Prior Publication Data

US 2010/0254120 A1 Oct. 7, 2010

(30) Foreign Application Priority Data

Apr. 7, 2009 (CN) ..... 2009 2 0148596 U

(51) Int. Cl.
*F21V 21/00* (2006.01)

(52) U.S. Cl. ..... 362/103; 362/276; 362/183; 362/802; 362/806

(58) Field of Classification Search ..... 362/103–106, 362/108, 183, 189, 276, 122
See application file for complete search history.

(56) References Cited

U.S. PATENT DOCUMENTS 5,709,464 A * 1/1998 Tseng ..... 362/276
6,474,830 B1 * 11/2002 Hansen ..... 362/103
7,170,019 B2 * 1/2007 Wong et al. ..... 200/61.45 M
7,350,720 B2 * 4/2008 Jaworski et al. ..... 239/55
7,390,103 B2 * 6/2008 Chang ..... 362/154
7,896,515 B2 * 3/2011 Yang ..... 362/103
2008/0253108 A1 * 10/2008 Ellenburg et al. ..... 362/103
2009/0091921 A1 * 4/2009 Yang ..... 362/103

* cited by examiner

*Primary Examiner* — Stephen F Husar
*Assistant Examiner* — James Cranson, Jr.

(57) ABSTRACT

The invention discloses a light-emitting decorative accessory which includes a shaft, a first shoulder, a second shoulder, and a light-emitting module. The first shoulder and the second shoulder connect two opposite ends of the shaft respectively. The shaft has hollow space therein, and the outer diameter of the shaft is shorter than each outer diameter of the first shoulder and the second shoulder. The second shoulder has an upper surface with an aperture forming through the second shoulder and protruding to the hollow space inside the shaft. The light-emitting module includes a light-emitting unit, a circuit board, and a vibration switch for triggering the light-emitting unit. The light-emitting unit is electrically connected to the circuit board disposed on the upper surface of the second shoulder. The vibration switch is contained inside the hollow space inside the shaft and electrically connected to the circuit board.

12 Claims, 6 Drawing Sheets

LIGHT-EMITTING DECORATIVE ACCESSORY

BACKGROUND OF THE INVENTION

1. Field of the Invention

The present invention relates to a decorative accessory; more particularly, the light-emitting decorative accessory is light-emittable and has visual effects.

2. Description of the Prior Art

In the tradition, decorations, e.g. badges, buttons, etc. applied to shoes, hats, backpacks, and clothing are usually in the stationary type. Although they provide decorative effects, there are the following general shortcomings.

1. Unchangeable

Because most the traditional decorations are in the stationary type and unchangeable, it is not allowed for people preferring changes to make changes on the appearances of things decorated with these decorations.

2. Low Interest

Because the traditional decorations are unchangeable and not able to emit light, it is boring to use.

3. No Caution Function

Generally, these traditional decorations merely provide decorative effects and cannot emit light, so they do not have warning effects when the user moves in the night.

SUMMARY OF THE INVENTION

In consideration of the above problems, one scope of the invention is to provide a light-emitting decorative accessory which is particularly changeable, light-emittable, and has visual effects.

According to an embodiment of the invention, the light-emitting decorative accessory includes a shaft, a first shoulder, a second shoulder, and a light-emitting module.

The shaft has a first end and a second end opposite to the first end. The shaft has hollow space therein. The first shoulder connects the first end of the shaft, while the second shoulder connects the second end of the shaft. The outer diameter of the shaft is shorter than each outer diameter of the first shoulder and the second shoulder. Besides, the second shoulder has an upper surface with an aperture forming through the second shoulder and protruding to the hollow space inside the shaft.

The light-emitting module includes a light-emitting unit, a circuit board, a power module, and a vibration switch for triggering the light-emitting unit. The light-emitting unit is electrically connected to the circuit board disposed on the upper surface of the second shoulder. In a preferred embodiment, the edge of the upper surface of the second shoulder protrudes upwardly to form a surrounding wall so that there is a recess within the surrounding wall. Thus, the circuit board of the light-emitting module is disposed in the recess, and the aperture on the second shoulder is at the bottom of the recess.

The power module is disposed between the circuit board and the bottom of the recess and electrically connected to the circuit board. In addition, the vibration switch is contained inside the hollow space inside the shaft and electrically connected to the circuit board. In a further embodiment, the light-emitting module includes a solar cell disposed on the circuit board and electrically connected to the power module.

In an embodiment, the second end of the shaft connects the bottom of the second shoulder. Moreover, the second shoulder itself defines a center; the joint of the shaft and the second shoulder is some distance away from the center of the second shoulder. Briefly speaking, the overall shaft is offsetted relative to the center of the second shoulder.

It is noted that because the outer diameter of the shaft is shorter than each outer diameter of the first shoulder and the second shoulder, the first shoulder has a first block surface at the first end of the shaft, while the second shoulder has a second block surface at the second end of the shaft.

In practical applications, the first shoulder is used to put into an aperture of an object so as to be placed inside the object, wherein the first block surface is used to block an inner surface of the object adjacent the aperture, while the second block surface is used to block an outer surface the of the object adjacent the aperture. Therefore, after the first shoulder passes through the aperture of the object, the first shoulder can be fixed at the object by use of the first block surface and the second block surface.

In a further embodiment, the light-emitting decorative accessory includes a modeled decoration having a translucent casing and inner space within the casing, wherein the second shoulder is disposed inside the inner space. The inner space of the translucent casing is used to receive the second shoulder such that the light-emitting unit within the recess of the second shoulder is also within the inner space of the translucent casing. Accordingly, light emitting from the light-emitting unit can radiate from the interior to the exterior of the translucent casing.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
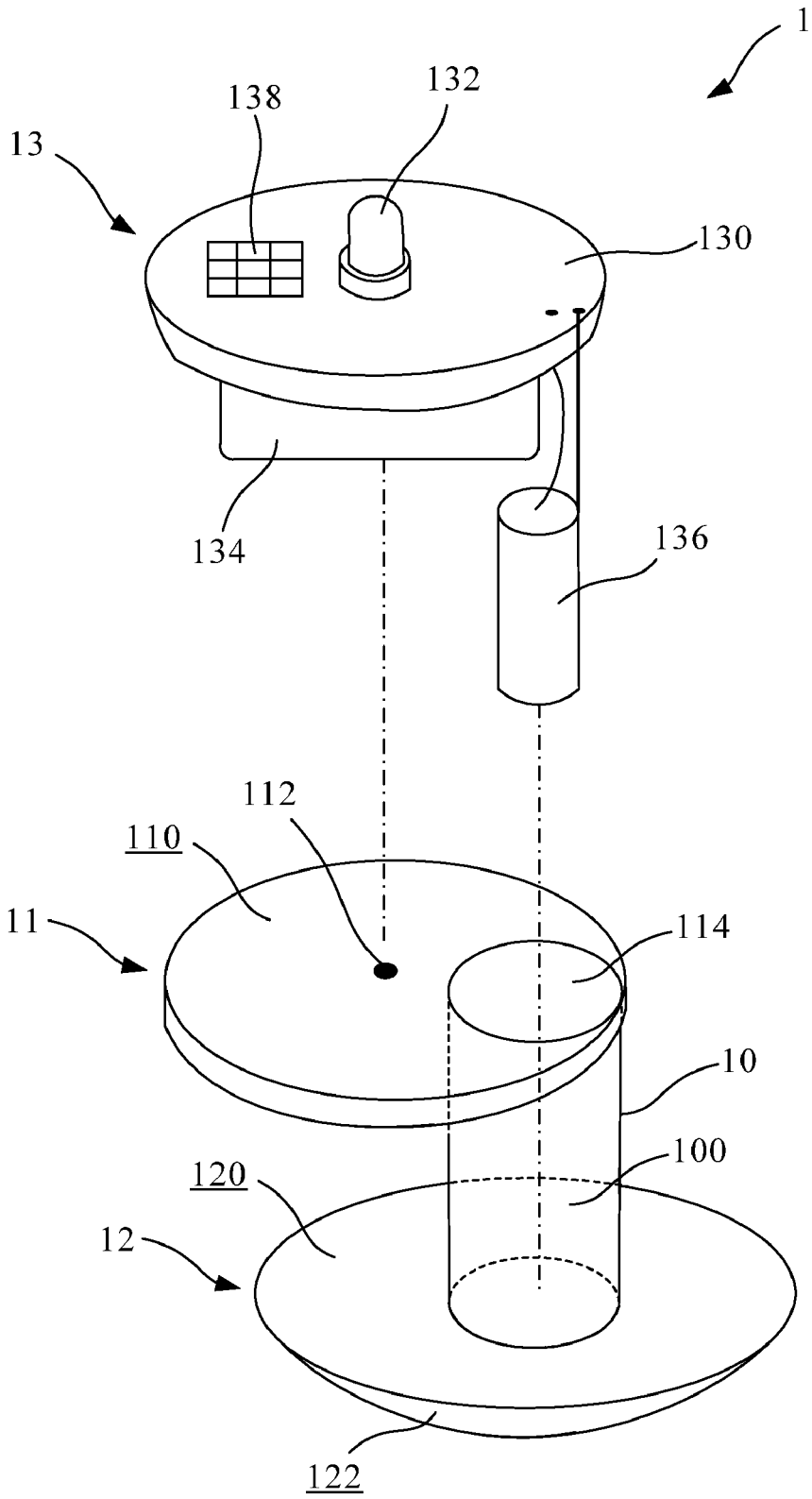
FIG. 1 illustrates an explosion and partial perspective diagram of the light-emitting decorative accessory according to an embodiment of the invention.
Figure 2:
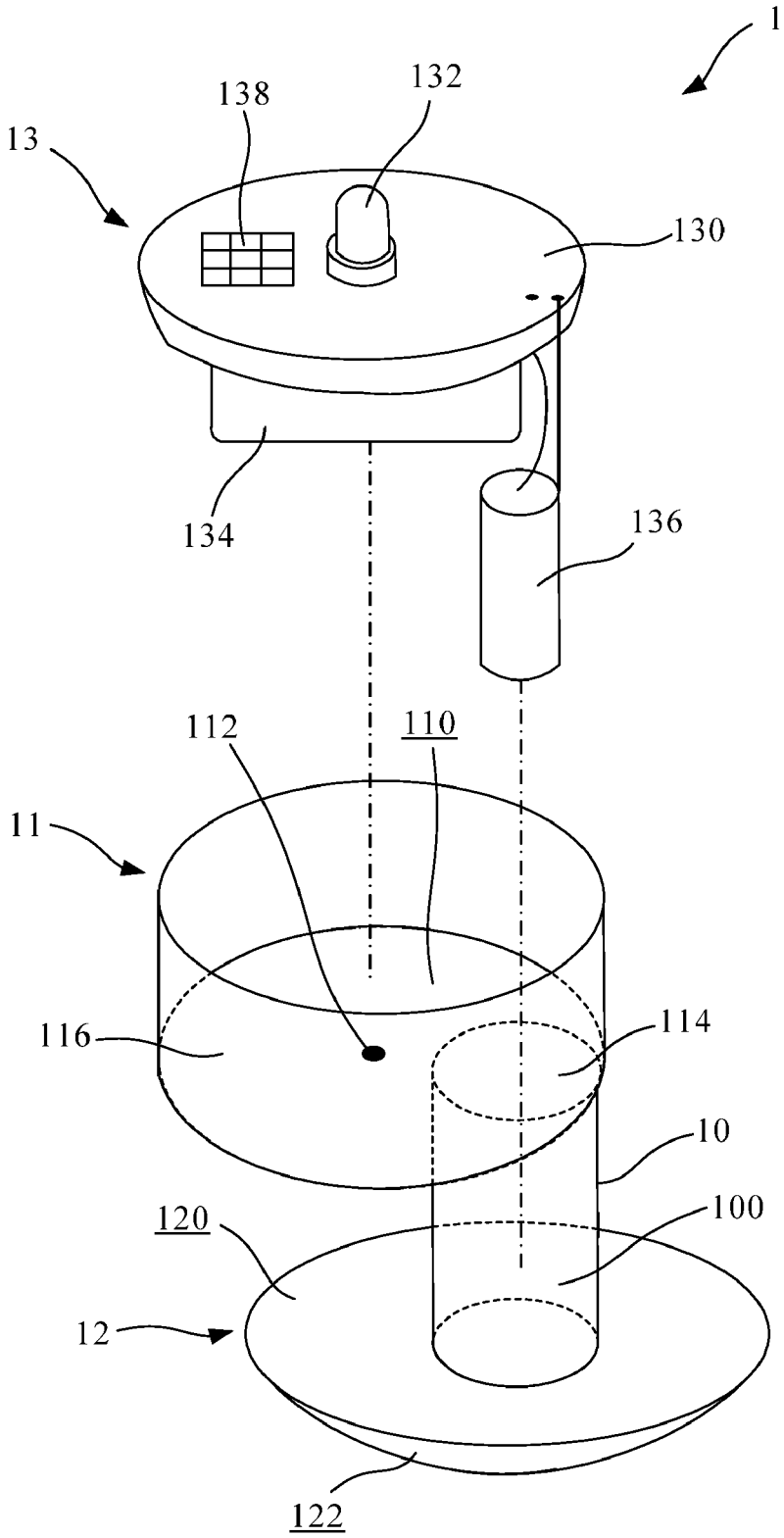
FIG. 2 illustrates an explosion and partial perspective diagram of the light-emitting decorative accessory according to another embodiment of the invention.

Please refer to FIG. 1 and FIG. 2. FIG. 1 illustrates an explosion and partial perspective diagram of the light-emitting decorative accessory 1 according to an embodiment of the invention. FIG. 2 illustrates an explosion and partial perspective diagram of the light-emitting decorative accessory 1 according to another embodiment of the invention.

As shown in FIG. 1, the light-emitting decorative accessory 1 includes a shaft 10, a first shoulder 12, a second shoulder 11, and a light-emitting module 13.

The shaft 10 has a first end and a second end opposite to the first end. It should be noted that the shaft 10 is a hollow structure and has hollow space 100 therein. Besides, the second shoulder 11 has an upper surface 110 with an aperture 114 corresponding to the hollow space 100 inside the shaft 10. It is emphasized that the aperture 114 forms through the second shoulder 11 from the upper surface 110 and protrudes to the hollow space 100 inside the shaft 10. That is to say, the hollow space 100 can lead to the outside of the upper surface 110 of the second shoulder 11.

As shown in FIG. 1, the first shoulder 12 connects the first end of the shaft 10, while the second shoulder 11 connects the second end of the shaft 10. In addition, the outer diameter of the shaft 10 is shorter than each outer diameter of the first shoulder 12 and the second shoulder 11. It should be explained that because the outer diameter of the shaft 10 is shorter than each outer diameter of the first shoulder 12 and the second shoulder 11, the first shoulder 12 has a first block surface 120 at the first end of the shaft 10, while the second shoulder 11 has a second block surface at the second end of the shaft 10 (see FIG. 5A).

In an embodiment, the second end of the shaft 10 connects the bottom of the second shoulder 11. Moreover, the second shoulder 11 itself defines a center 112; the joint of the shaft 10 and the bottom of the second shoulder 11 is some distance away from the center 112 of the second shoulder 11. Briefly speaking, the overall shaft 10 is offsetted relative to the center 112 of the second shoulder 11.

As shown in FIG. 1, the bottom of the first shoulder 12 has a curved surface 122. Furthermore, because the first shoulder 12 has a button-like shape, the first shoulder 12 can be buckled as a button on an object having a stretchable hole.

In practical operations, the first shoulder 12 is used to put into a stretchable aperture of an object so as to be placed inside the object, wherein the first block surface 120 of the first shoulder 12 is used to block an inner surface of the object adjacent the aperture, while the second block surface 118 of the first shoulder 11 is used to block an outer surface the of the object adjacent the aperture. Therefore, after the first shoulder 12 passes through the aperture of the object from outside, the first shoulder 12 can be fixed on the object by use of the first block surface 120 and the second block surface 118.

The light-emitting module 13 includes a light-emitting unit 132, a circuit board 130, a power module 134, and a vibration switch 136 for triggering the light-emitting unit 132. In practical applications, the light-emitting unit 132 can be a light-emitting diode. The light-emitting unit 132 is electrically connected to the circuit board 130 disposed on the upper surface 110 of the second shoulder 11. As shown in the embodiment of FIG. 1, the power module 134 is disposed between the circuit board 130 and the upper surface 110 of the second shoulder 11 and electrically connected to the circuit board 130. In the embodiment, the cross-section area of the power module 134 is substantially the same as that of the circuit board 130.

Figure 5A:
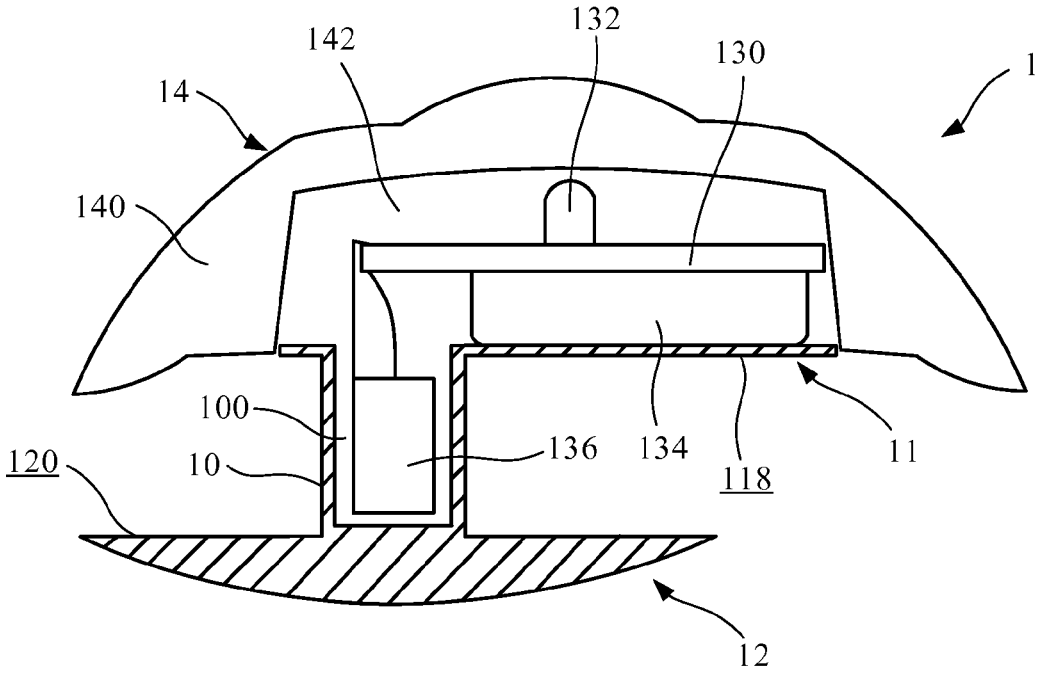
FIG. 5A and FIG. 5B illustrate cross section views of the light-emitting decorative accessory of the invention.

Please refer to FIG. 5A which illustrates a cross section view of the light-emitting decorative accessory 1 in the embodiment. It must be emphasized that the vibration switch 136 is contained inside the hollow space 100 inside the shaft 10, and the conducting wire of the vibration switch 136 can extend through the aperture 114 of the second shoulder 11 to be electrically connected to the circuit board 130.

It is additionally explained that because the vibration switch 136 is contained inside the hollow space 100 inside the shaft 10, the overall light-emitting module 13 of the light-emitting decorative accessory 1 requires less space volume. Accordingly, it can minimize the dimension of the second shoulder 11 for holding the light-emitting module 13. Due to the proper utilization of the hollow space 100 inside the shaft 10, the exterior volume of the light-emitting decorative accessory 1 can be decreased further.

In a further embodiment, the light-emitting module 13 can include a solar cell 138 disposed on the circuit board 130 and electrically connected to the power module 134. The solar cell 138 can provide electricity to the power module 134 through its photo-electric conversion efficiency so as to sustain the motivation of the light-emitting module 13.

Please refer to FIG. 2. In a preferred embodiment, the edge of the upper surface 110 of the second shoulder 11 can protrude upwardly to form a surrounding wall 116 so that there is a recess within the surrounding wall 116. Hence, the circuit board 130 of the light-emitting module 13 can be disposed in the recess, and the aperture 114 on the second shoulder 11 is at the bottom of the recess. In addition, the power module 134 is disposed between the circuit board 130 and the bottom of the recess and electrically connected to the circuit board 130. The surrounding wall 116 can restrict the light-emitting module 13 within the recess and protect it, e.g. to avoid the damage due to external impact.

Figure 5B:
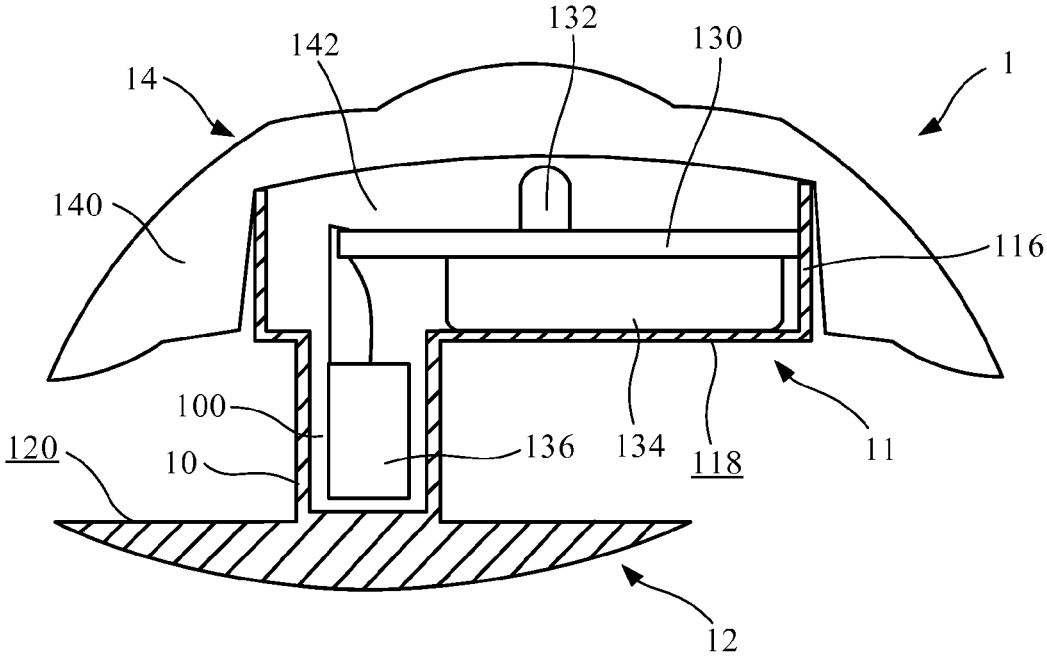

Please refer to FIG. 5B which illustrates the cross section view of the light-emitting decorative accessory 1 in FIG. 2. The vibration switch 136 is contained inside the hollow space 100 inside the shaft 10, and the conducting wire of the vibration switch 136 can extend through the aperture 114 of the second shoulder 11 to be electrically connected to the circuit board 130.

Figure 7A:
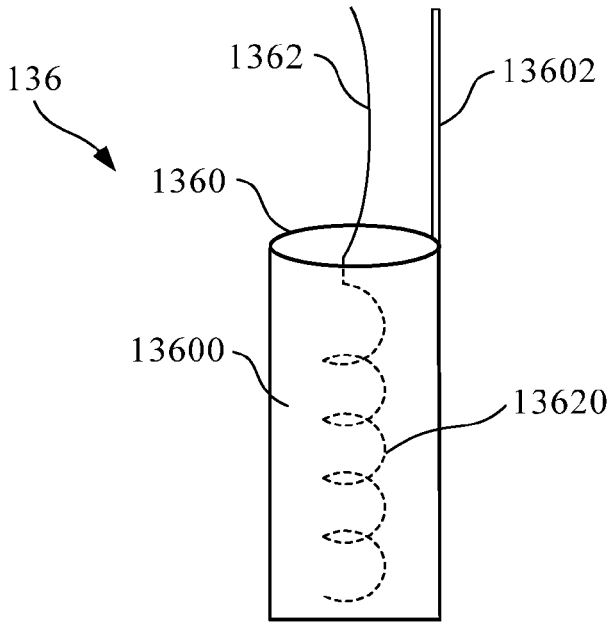
FIG. 7A and FIG. 7B illustrate side and perspective views of the vibration switch.
Figure 7B:
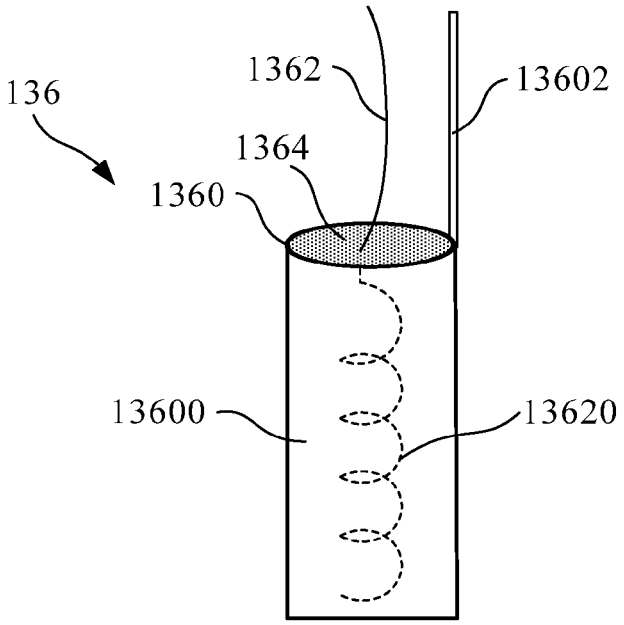

Please refer to FIG. 7A and FIG. 7B which illustrate side and perspective views of the vibration switch 136. The vibration switch 136 includes an electrically conductive container 1360 and an electrically conductive pin 1362. The container 1360 has a surrounding casing 13600 so that there is receiving space within the surrounding casing 13600. Moreover, the top of the surrounding casing 13600 protrudes upwardly to form an extension portion 13602 electrically connected to the circuit board 130. One end of the pin 1362 has a spring portion 13620 located inside the receiving space, and the other end of the pin 1362 is electrically connected to the circuit board 130. Therefore, if the spring portion 13620 contacts the surrounding casing 13600 during the vibration of the vibration switch 136, the light-emitting unit 132 will be triggered to emit light.

The receiving space of the container 1360 has an opening, and in practical applications, the opening can be sealed by an insulated cover 1364 (as shown in FIG. 7B) having a through hole. Thereby, the other end of the pin 1362 goes through the through hole to be electrically connected to the circuit board 130.

Figure 3:
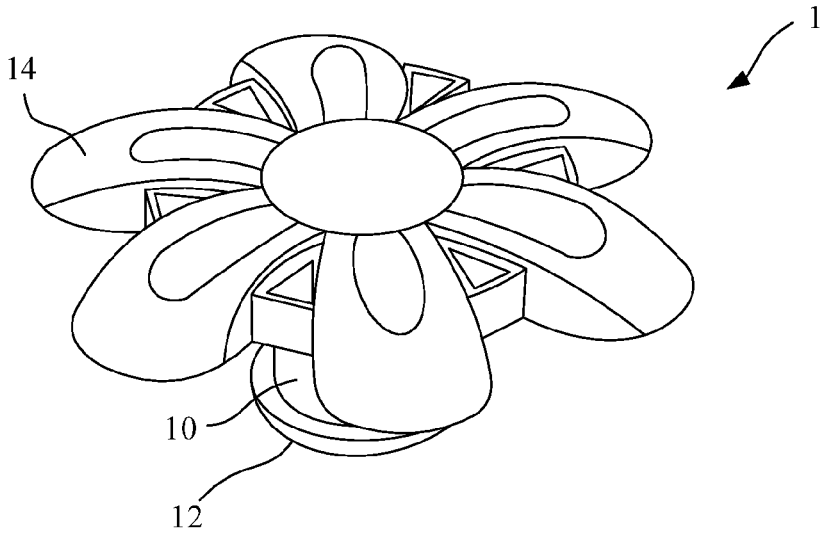
FIG. 3 illustrates a schematic diagram of the light-emitting decorative accessory of the invention capped with a modeled decoration.

Please refer to FIG. 3 which illustrates a schematic diagram of the light-emitting decorative accessory 1 of the invention capped with a modeled decoration 14.

The modeled decoration 14 can have a solid shape with a specific appearance, e.g. animals, plants, characters, and cartoon figures in practical applications. Taking FIG. 3 as an example, the decorative accessory 1 is capped with a flower-shaped modeled decoration 14, and the decorative accessory 1 of the invention has more decorative effects by use of the appearance of the modeled decoration 14.

In the structure as shown in FIG. 5A and FIG. 5B, the modeled decoration 14 has a translucent casing 140 and inner space 142 within the casing 140. The inner space 142 of the translucent casing 140 is used to receive the second shoulder 11 such that the light-emitting unit 132 within the second shoulder 11 is also within the inner space 142 of the translcent casing 140. Accordingly, light emitting from the light-emitting unit 132 can radiate from the interior to the exterior of the translucent casing 140.

Figure 4:
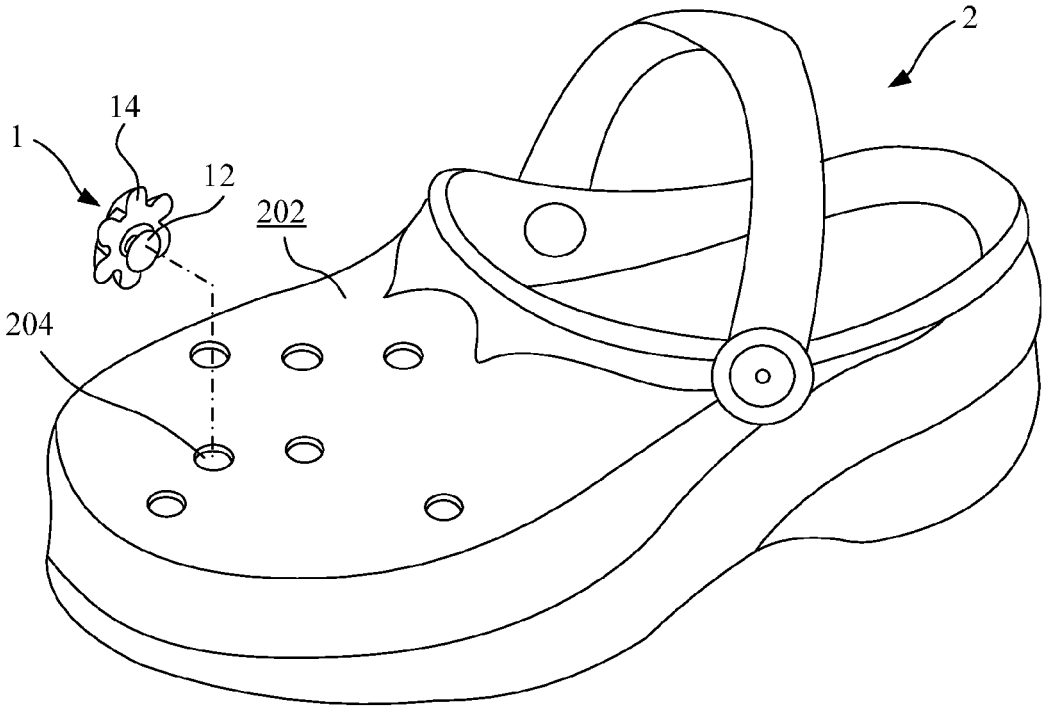
FIG. 4 illustrates a schematic diagram of the light-emitting decorative accessory of the invention inserted into a shoe.

In practical applications, the decorative accessory 1 capped with the modeled decoration 14 can be combined to an object for decoration. Please refer to FIG. 4 which illustrates a schematic diagram of the light-emitting decorative accessory 1 of the invention inserted into a shoe 2. As shown in FIG. 4, the object to which the decorative accessory is combined can be a rubber shoe having plural apertures 204 on the outer surface 204 of the shoe. Since the shoe is made of rubber, these apertures 204 can be stretched outwardly slightly. It is noted that FIG. 4 merely illustrates an example; that is, the practical application is not limited to such shoe.

Figure 6A:
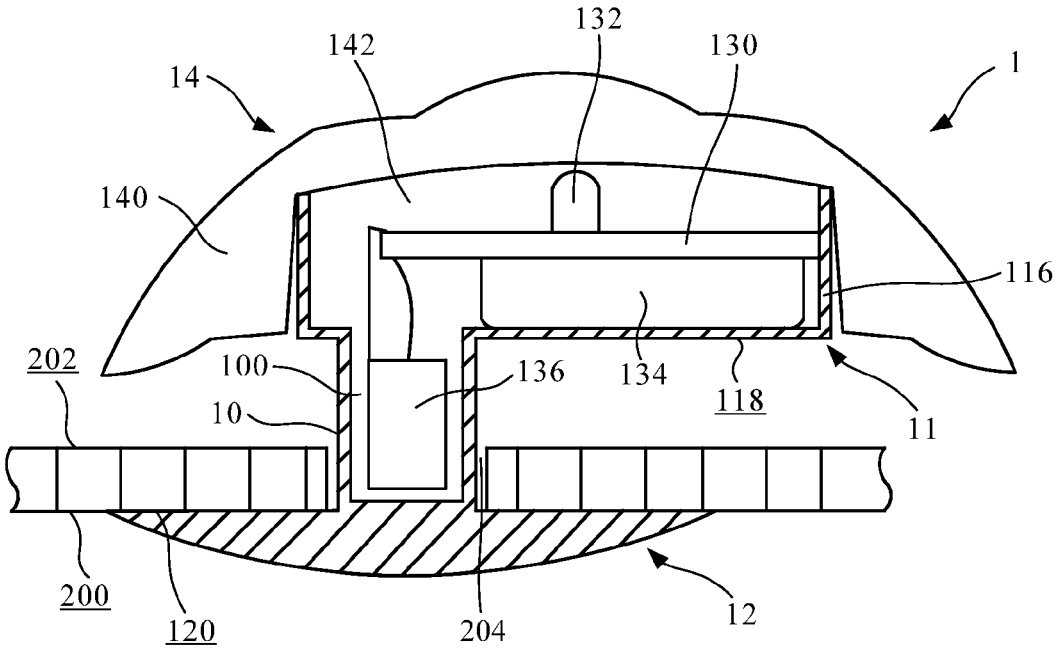
FIG. 6A illustrates a cross section view of the light-emitting decorative accessory of the invention inserted into an aperture of an object.

Please refer to FIG. 6A which illustrates the cross section view of the light-emitting decorative accessory 1 of the invention inserted into the aperture 204. The first shoulder 12 of the decorative accessory 1 can be put into the aperture 204 of the shoe 2 so as to make the first block surface 120 of the first shoulder 12 and the second block surface 118 of the first shoulder 11 blocked by the inner surface 200 and the outer surface 202 adjacent the aperture 204 of the shoe 2. Thus, the light-emitting decorative accessory 1 can be positioned upon the shoe 2, and the modeled decoration 14 is exposed on the outer surface 202 of the shoe 2 to increase the decorative effect of the shoe 2. In practical applications, a user can dress, according to his interest, the outer surface 202 of the shoe 2 with plural modeled decorations having various shapes.

Furthermore, if the modeled decoration 14 of the light-emitting decorative accessory 1 needs to be unloaded or changed, the user just needs to pull out the first shoulder 12 from the aperture 204 to make the decorative accessory 1 and the shoe 2 separated; in the meantime, the user finishes unloading or is able to change the modeled decoration 14.

Figure 6B:
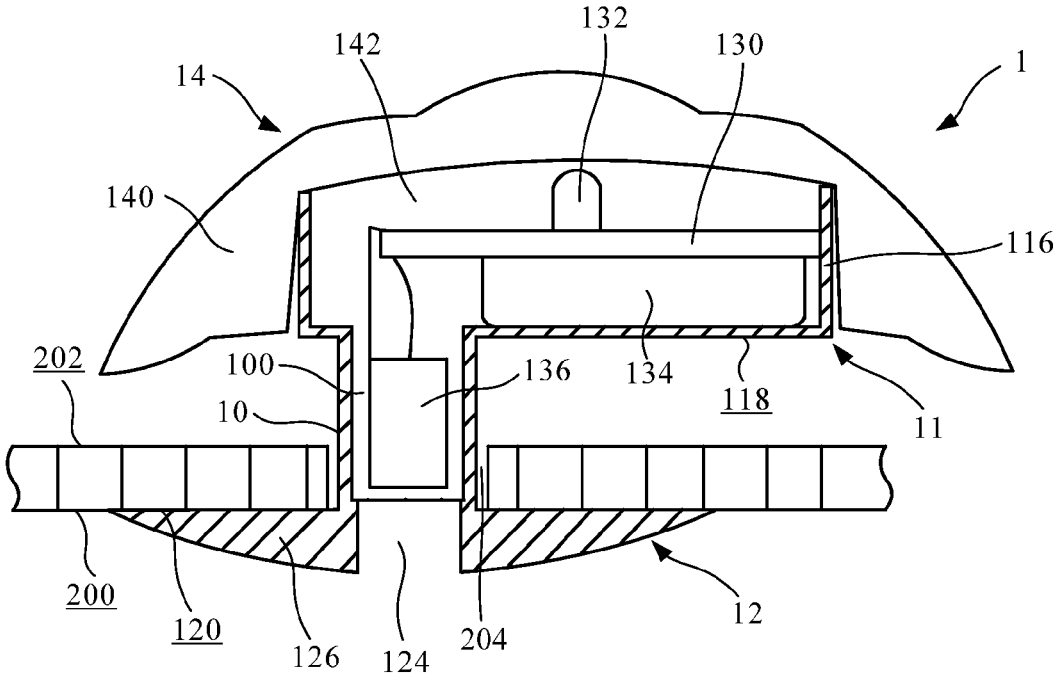
FIG. 6B illustrates a cross section view of the circumference of the first shoulder of the light-emitting decorative accessory of the invention having at least one radial breach.

Please refer to FIG. 6B which illustrates a cross section view of the circumference of the first shoulder 12 of the light-emitting decorative accessory 1 having at least one radial breach 124. The first shoulder 12 is divided into plural blades 126 due to the formation of the radial breach 124. Therefore, while the first shoulder 12 is being inserted into the aperture 204 of the shoe 2, each blade 126 can be squeezed inwardly to suppress the stretch of the first shoulder 12 which then passes through the aperture 204 easily; similarly, while the first shoulder 12 is being pulled out from the aperture 204, each blade 126 can be squeezed inwardly again to smooth this process. Hence, the design of the radial breach 124 is convenient for assembling and unloading the first shoulder 12.

Furthermore, if the light-emitting module 13 of the light-emitting decorative accessory 1 is vibrated because of the movement of the user, the vibration switch 136 of the light-emitting module 13 will sense the vibration and trigger the light-emitting unit 132 to glisten; accordingly, the light-emitting unit 132 enhances the practical utility because it not only increases the decoration effect and interest but also serves as a caution light when the user moves in the night.

To sum up, the light-emitting decorative accessory of the invention has the primary merit of being disassembled freely from things such as shoes, hats, backpacks, and clothing; thus, it is particularly changeable to meet people preferring changes. Moreover, since the decorative accessory of the invention has the light-emitting function, it not only increases the visual effect and interest but also serves as a caution light when the user moves in the night.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting decorative accessory, comprising:

a shaft having a first end and a second end opposite to the first end, the shaft having hollow space therein;

a first shoulder connecting the first end of the shaft;

a second shoulder connecting the second end of the shaft, the outer diameter of the shaft being shorter than each outer diameter of the first shoulder and the second shoulder, the second shoulder having an upper surface with an aperture forming through the second shoulder and protruding to the hollow space inside the shaft; and a light-emitting module comprising a light-emitting unit, a circuit board, and a vibration switch for triggering the light-emitting unit, the light-emitting unit being electrically connected to the circuit board disposed on the upper surface of the second shoulder, the vibration switch being contained inside the hollow space inside the shaft and electrically connected to the circuit board.

2. The light-emitting decorative accessory of claim 1, wherein the second shoulder itself defines a center, and the overall shaft is offsetted relative to the center.

3. The light-emitting decorative accessory of claim 1, wherein the edge of the upper surface of the second shoulder protrudes upwardly to form a surrounding wall so that there is a recess within the surrounding wall, the circuit board is disposed in the recess.

4. The light-emitting decorative accessory of claim 1, wherein the light-emitting module comprises a power module disposed between the circuit board and the upper surface of the second shoulder and electrically connected to the circuit board.

5. The light-emitting decorative accessory of claim 4, wherein the light-emitting module comprises a solar cell disposed on the circuit board and electrically connected to the power module.

6. The light-emitting decorative accessory of claim 4, wherein the cross-section area of the power module is substantially the same as that of the circuit board.

7. The light-emitting decorative accessory of claim 1, wherein the bottom of the first shoulder has a curved surface.

8. The light-emitting decorative accessory of claim 1, wherein the circumference of the first shoulder has at least one radial breach.

9. The light-emitting decorative accessory of claim 1, wherein the first shoulder has a first block surface at the first end of the shaft, the second shoulder has a second block surface at the second end of the shaft, the first shoulder is used to put into an aperture of an object so as to be placed inside the object, the first block surface is used to block an inner surface of the object adjacent the aperture, while the second block surface is used to block an outer surface the of the object adjacent the aperture.

10. The light-emitting decorative accessory of claim 1, further comprising:

a modeled decoration having a translucent casing and inner space within the casing, wherein the second shoulder is disposed inside the inner space.

11. The light-emitting decorative accessory of claim 1, wherein the vibration switch comprises an electrically conductive container and an electrically conductive pin, the container has a surrounding casing so that there is receiving space within the surrounding casing, the top of the surrounding casing protrudes upwardly to form an extension portion electrically connected to the circuit board, one end of the pin has a spring portion located inside the receiving space, and the other end of the pin is electrically connected to the circuit board.

12. The light-emitting decorative accessory of claim 11, wherein the container has an opening sealed by an insulated cover having a through hole, the other end of the pin goes through the through hole to be electrically connected to the circuit board.

* * * * *